US005657422A

United States Patent [19]

Janiszewski et al.

[11] Patent Number: 5,657,422

[45] Date of Patent: Aug. 12, 1997

[54] VOICE ACTIVITY DETECTION DRIVEN NOISE REMEDIATOR

[75] Inventors: Thomas John Janiszewski, Clinton; Michael Charles Recchione, Nutley, both of N.J.

[73] Assignee: Lucent Technologies Inc., Murray Hill, N.J.

[21] Appl. No.: 188,294

[22] Filed: Jan. 28, 1994

[51] Int. Cl.[6] ..... G10L 3/02; G10L 9/00

[52] U.S. Cl. ..... 395/2.37; 395/2.42

[58] Field of Search ..... 395/2.42, 2, 2.37, 395/2.09, 2.35; 370/81, 32

[56] References Cited

U.S. PATENT DOCUMENTS

| | | | |
|---|---|---|---|
| 4,720,802 | 1/1988 | Damoulakis et al. | 395/2.42 |
| 4,864,561 | 9/1989 | Ashenfelter et al. | 370/81 |
| 5,276,765 | 1/1994 | Freeman et al. | 395/2.42 |
| 5,410,632 | 4/1995 | Hong et al. | 395/2.42 |
| 5,459,814 | 10/1995 | Gupta et al. | 395/2.42 |

FOREIGN PATENT DOCUMENTS

| | | | |
|---|---|---|---|
| 2256351 | 12/1992 | United Kingdom | H04B 3/20 |
| 9111380 | 12/1992 | United Kingdom . | |
| 9211393 | 12/1992 | United Kingdom . | |

OTHER PUBLICATIONS

Freeman et al., "The voice activity detector for the Pan-European digital cellular mobile telephone service", ICASSP-89, pp. 369-372, vol. 1. May 1989.

"Discontinuous Transmission (DTX) for Full-Rate Speech Traffic Channels," ETSI/GSM, GSM 06.31 Jan. 1991.

"Voice Activity Detection," ETSI/GSM, GSM 0.632 Jan. 1991.

"Speech Codec Specification," Qualcomm, Inc., San Diego, CA, 1992.

"TR45 Full-Rate Speech Codec Compatability Standard PN-2972," Electronic Industries Association, Washington, D.C., 1990.

Atal, Bishnu S. and Rabiner, Lawrence R., "A Pattern Recognition Approach to Voiced-Unvoiced-Silence Classification with Applications to Speech Recognition," IEEE Transactions on Acoustics, Speech, and Signal Processing, vol. ASSP-24, No. 3, Jun. 1976, pp. 201-212.

Drago, P.G., Molinari, A.M., and Vagliani, F.C., "Digital Dynamic Speech Detectors," IEEE Transactions on Communications, vol. COM-26, No. 1, Jan. 1978, pp. 140-145.

Chan, Wai-Yip and Falconer, David D., "Speech Detection For A Voice/Data Mobile Radio Terminal," IEEE International Conference on Communications: Integrating Communication for World Progress, Boston, Massachusetts, Jun. 19-22, 1983, Conference Record vol. 3 of 3, pp. 1650-1654.

Rabiner, L.R., Schmidt, C.E., and Atal, B.S., "Evaluation of a Statistical Approach to Voiced-Unvoiced-Silence Analysis for Telephone-Quality Speech," The Bell System Technical Journal, vol. 56, No. 3, Mar. 1977, pp. 455-482.

Yatsuzuka, Yohtaro, "Highly Sensitive Speech Detector and High-Speed Voiceband Data Discriminator in DSI-AD-PCM Systems," IEEE Transactions on Communications, vol. COM-30, No. 4, Apr. 1982, pp. 739-750.

(List continued on next page.)

*Primary Examiner*—Allen R. MacDonald
*Assistant Examiner*—Richemond Dorvil

[57] ABSTRACT

A method and apparatus for improving sound quality in a digital cellular radio system receiver. A voice activity detector uses an energy estimate to detect the presence of speech in a received speech signal in a noise environment. When no speech is present the system attenuates the signal and inserts low pass filtered white noise. In addition, a set of high pass filters are used to filter the signal based upon the background noise level. This high pass filtering is applied to the signal regardless of whether speech is present. Thus, a combination of signal attenuation with insertion of low pass filtered white noise during periods of non-speech, along with high pass filtering of the signal, improves sound quality when decoding speech which has been encoded in a noisy environment.

35 Claims, 6 Drawing Sheets

OTHER PUBLICATIONS

"Comfort Noise Aspects For Full–Rate Speech Traffic Channels," ETSI/GSM, GSM 06.12 Jan. 1991.

C. B. Southcott, et al., "Voice Control of the Pan–European Digital Mobile Radio System", *Globecom* '89, vol. 2, Nov. 27, 1989, pp. 1070–1074.

"Coherent Digital Cellular Speech Made Possible Through Audio+", Mobile Phone News, Sep. 6, 1993 pp. 6–7.

VOICE ACTIVITY DETECTION DRIVEN NOISE REMEDIATOR

FIELD OF THE INVENTION

The present invention relates generally to digital mobile radio systems. In particular, this invention relates to improving the voice quality in a digital mobile radio receiver in the presence of audio background noise.

BACKGROUND OF THE INVENTION

A cellular telephone system comprises three essential elements: a cellular switching system that serves as the gateway to the landline (wired) telephone network, a number of base stations under the switching system's control that contain equipment that translates between the signals used in the wired telephone network and the radio signals used for wireless communications, and a number of mobile telephone units that translate between the radio signals used to communicate with the base stations and the audible acoustic signals used to communicate with human users (e.g. speech, music, etc.).

Communication between a base station and a mobile telephone is possible only if both the base station and the mobile telephone use identical radio modulation schemes, data-encoding conventions, and control strategies, i.e. both units must conform to an air-interface specification. A number of standards have been established for air-interfaces in the United States. Until recently, all cellular telephony in the United States has operated according to the Advanced Mobile Phone Service (AMPS) standard. This standard specifies analog signal encoding using frequency modulation in the 800 MHz region of the radio spectrum. Under this scheme, each cellular telephone conversation is assigned a communications channel consisting of two 30 KHz segments of this region for the duration of the call. In order to avoid interference between conversations, no two conversations may occupy the same channel simultaneously within the same geographic area. Since the entire portion of the radio spectrum allocated to cellular telephony is finite, this restriction places a limit on the number of simultaneous users of a cellular telephone system.

In order to increase the capacity of the system, a number of alternatives to the AMPS standard have been introduced. One of these is the Interim Standard-54 (IS-54), issued by the Electronic Industries Association and the Telecommunications Industry Association. This standard makes use of digital signal encoding and modulation using a time division multiple access (TDMA) scheme. Under the TDMA scheme, each 30 KHz segment is shared by three simultaneous conversations, and each conversation is permitted to use the channel one-third of the time. Time is divided into 20 ms frames, and each frame is further sub-divided into three time slots. Each conversation is allotted one time slot per frame.

To permit all of the information describing 20 ms of conversation to be conveyed in a single time slot, speech and other audio signals are processed using a digital speech compression method known as Vector Sum Excited Linear Prediction (VSELP). Each IS-54 compliant base station and mobile telephone unit contains a VSELP encoder and decoder. Instead of transmitting a digital representation of the audio waveform over the channel, the VSELP encoder makes use of a model of human speech production to reduce the digitized audio signal to a set of parameters that represent the state of the speech production mechanism during the frame (e.g. the pitch, the vocal tract configuration, etc.).

These parameters are encoded as a digital bit-stream, and are then transmitted over the channel to the receiver at 8 kilobits per second (kbs). This is a much lower bit rate than would be required to encode the actual audio waveform. The VSELP decoder at the receiver then uses these parameters to re-create an estimate of the digitized audio waveform. The transmitted digital speech data is organized into digital information frames of 20 ms, each containing 160 samples. There are 159 bits per speech frame. The VSELP method is described in detail in the document, *TR45 Full-Rate Speech Codec Compatibility Standard PN-2972*, 1990, published by the Electronics Industries Association, which is fully incorporated herein by reference (hereinafter referred to as "VSELP Standard").

VSELP significantly reduces the number of bits required to transmit audio information over the communications channel. However, it achieves this reduction by relying heavily on a model of speech production. Consequently, it renders non-speech sounds poorly. For example, the interior of a moving automobile is an inherently noisy environment. The automobile's own sounds combine with external noises to create an acoustic background noise level much higher than is typically encountered in non-mobile environments. This situation forces VSELP to attempt to encode non-speech information much of the time, as well as combinations of speech and background noise.

Two problems arise when VSELP is used to encode speech in the presence of background noise. First, the background noise sounds unnatural whether or not there is speech present, and second, the speech is distorted in a characteristic way. Individually and collectively these problems are commonly referred to as "swirl".

While it would be possible to eliminate these artifacts introduced by the encoding/decoding process by replacing the VSELP algorithm with another speech compression algorithm that does not suffer from the same deficiencies, this strategy would require changing the IS-54 Air Interface Specification. Such a change is undesirable because of the considerable investment in existing equipment on the part of cellular telephone service providers, manufacturers and subscribers. For example, in one prior art technique, the speech encoder detects when no speech is present and encodes a special frame to be transmitted to the receiver. This special frame contains comfort noise parameters which indicate that the speech decoder is to generate comfort noise which is similar to the background noise on the transmit side. These special frames are transmitted periodically by the transmitter during periods of non-speech. This proposed solution to the swirl problem requires a change to the current VSELP speech algorithm because it introduces special encoded frames to indicate when comfort noise is to be generated. It is implemented at both the transmit and receive sides of the communication channel, and requires a change in the current air interface specification standard. It is therefore an undesirable solution.

SUMMARY OF THE INVENTION

One object of the present invention is to reduce the severity of the artifacts introduced by VSELP (or any other speech coding/decoding algorithm) when used in the presence of acoustic background noise, without requiring any changes to the air interface specification.

It has been determined that a combination of signal attenuation with comfort noise insertion during periods of non-speech, and selective high pass filtering based on an estimate of the background noise energy is an effective solution to the swirl problem discussed above.

In accordance with the present invention, a voice activity detector uses an energy estimate to detect the presence of speech in the received speech signal in a noise environment. When no speech is present, the system attenuates the signal and inserts low-pass filtered white noise (i.e. comfort noise) at an appropriate level. This comfort noise mimics the typical spectral characteristics of automobile or other background noise. This smoothes out the swirl making it sound natural. When speech is determined to be present in the signal by the voice activity detector, the synthesized speech signal is processed with no attenuation.

It has been determined that the perceptually annoying artifacts that the speech encoder introduces when trying to encode both speech and noise occur mostly in the lower frequency range. Therefore, in addition to the voice activity driven attenuation and comfort noise insertion, a set of high pass filters are used depending on the background noise level. This filtering is applied to the speech signal regardless of whether speech is present or not. If the noise level is found to be less than −52 db, no high pass filtering is used. If the noise level is between −40 db and −52 db, a high pass filter with a cutoff frequency of 200 Hz is applied to the synthesized speech signal. If the noise level is greater than −40 db, a high pass filter with a cutoff frequency of 350 Hz is applied. The result of these high pass filters is reduced background noise with little affect on the speech quality.

The invention described herein is employed at the receiver (either at the base station, the mobile unit, or both) and thus it may be implemented without the necessity of a change to the current standard speech encoding/decoding protocol.

DETAILED DESCRIPTION

Figure 1:
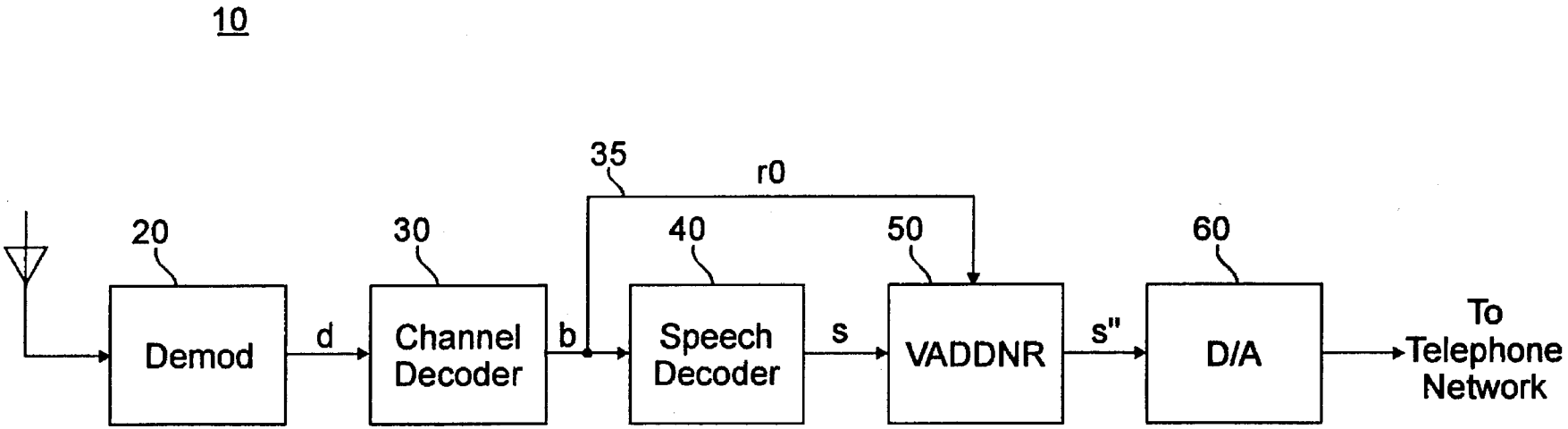
FIG. 1 is a block-diagram of a digital radio receiving system incorporating the present invention.

A digital radio receiving system 10 incorporating the present invention is shown in FIG. 1. A demodulator 20 receives transmitted waveforms corresponding to encoded speech signals and processes the received waveforms to produce a digital signal d. This digital signal d is provided to a channel decoder 30 which processes the signal d to mitigate channel errors. The resulting signal generated by the channel decoder 30 is an encoded speech bit stream b organized into digital information frames in accordance with the VSELP standard discussed above in the background of the invention. This encoded speech bit stream b is provided to a speech decoder 40 which processes the encoded speech bit stream b to produce a decoded speech bit stream s. This speech decoder 40 is configured to decode speech which has been encoded in accordance with the VSELP technique. This decoded speech bit stream s is provided to a voice activity detection driven noise remediator (VADDNR) 50 to remove any background "swirl" present in the signal during periods of non-speech. In one embodiment, the VADDNR 50 also receives a portion of the encoded speech bit stream b from the channel decoder 30 over signal line 35. The VADDNR 50 uses the VSELP coded frame energy value r0 which is part of the encoded bit stream b, as discussed in more detail below. The VADDNR 50 generates a processed decoded speech bit stream output s". The output from the VADDNR 50 may then be provided to a digital to analog converter 60 which converts the digital signal s" to an analog waveform. This analog waveform may then be sent to a destination system, such as a telephone network. Alternatively, the output from the VADDNR 50 may be provided to another device that converts the VADDNR output to some other digital data format used by a destination system.

Figure 2:
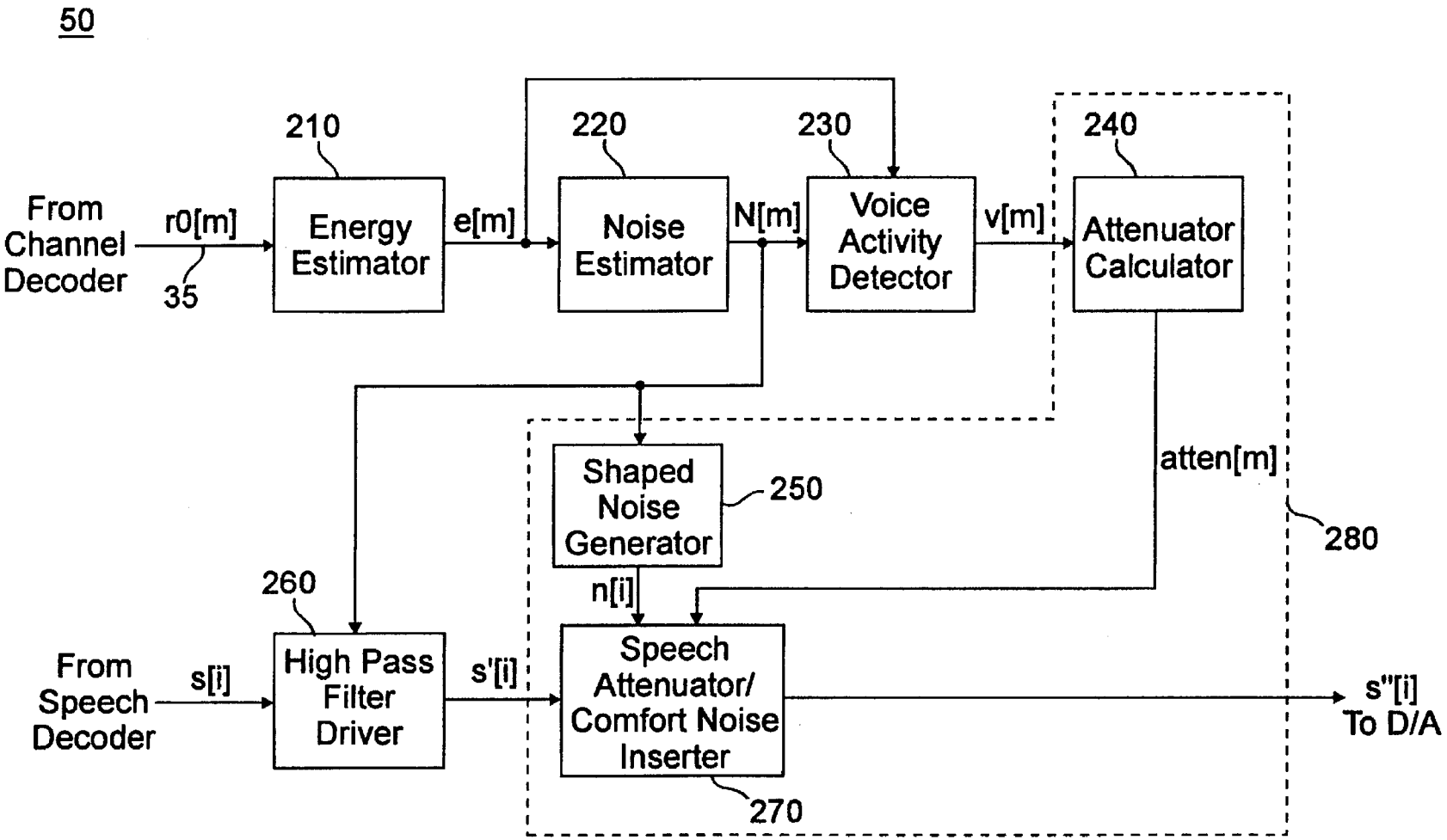
FIG. 2 is a block diagram of the voice activity detection driven noise remediator in accordance with the present invention.

The VADDNR 50 is shown in greater detail in FIG. 2. The VADDNR receives the VSELP coded frame energy value r0 from the encoded speech bit stream b over signal line 35 as shown in FIG. 1. This energy value r0 represents the average signal power in the input speech over the 20 ms frame interval. There are 32 possible values for r0, 0 through 31. r0=0 represents a frame energy of 0. The remaining values for r0 range from a minimum of −64 db, corresponding to r0=1, to a maximum of −4 db, corresponding to r0=31. The step size between r0 values is 2 db. The frame energy value r0 is described in more detail in *VSELP Standard*, p. 16. The coded frame energy value r0 is provided to an energy estimator 210 which determines the average frame energy.

The energy estimator 210 generates an average frame energy signal e[m] which represents the average frame energy computed during a frame m, where m is a frame index which represents the current digital information frame. e[m] is defined as:

$$e[m] = \begin{cases} Einit & \text{for } m = 0 \\ \alpha * r0[m] + (1-\alpha) * e[m-1] & \text{for } m > 0 \end{cases}$$

The average frame energy is initially set to an initial energy estimate Einit. Einit is set to a value greater than 31, which is the largest possible value for r0. For example, Einit could be set to a value of 32. After initialization, the average frame energy e[m] will be calculated by the equation $e[m]=\alpha*r0[m]+(1-\alpha)*e[m-1]$, where $\alpha$ is a smoothing constant with $0 \leqq \alpha \leqq 1$. $\alpha$ should be chosen to provide acceptable frame averaging. We have found that a value of $\alpha=0.25$ to be optimal, giving effective frame averaging over seven frames of digital information (140 ms). Different values of $\alpha$ could be chosen, with the value preferably being in the range of $0.25 \pm 0.2$.

As discussed above, and as shown in FIG. 1, the VADDNR 50 receives the VSELP coded frame energy value r0 from the encoded speech bit stream signal b prior to the signal b being decoded by the speech decoder 40. Alternatively, this frame energy value r0 could be calculated by the VADDNR 50 itself from the decoded speech bit stream signal s received from the speech decoder 40. In an embodiment where the frame energy value r0 is calculated by the VADDNR 50, there is no need to provide any part of the encoded speech bit stream b to the VADDNR 50, and signal line 35 shown in FIG. 1 would not be present. Instead, the VADDNR 50 would process only the decoded speech bit stream s, and the frame energy value r0 would be calculated as described in *VSELP Standard*, pp. 16–17. However, by providing r0 to the VADDNR 50 from the encoded bit stream b over signal line 35, the VADDNR can process the decoded speech bit stream s more quickly because it does not have to calculate r0.

Figure 3:
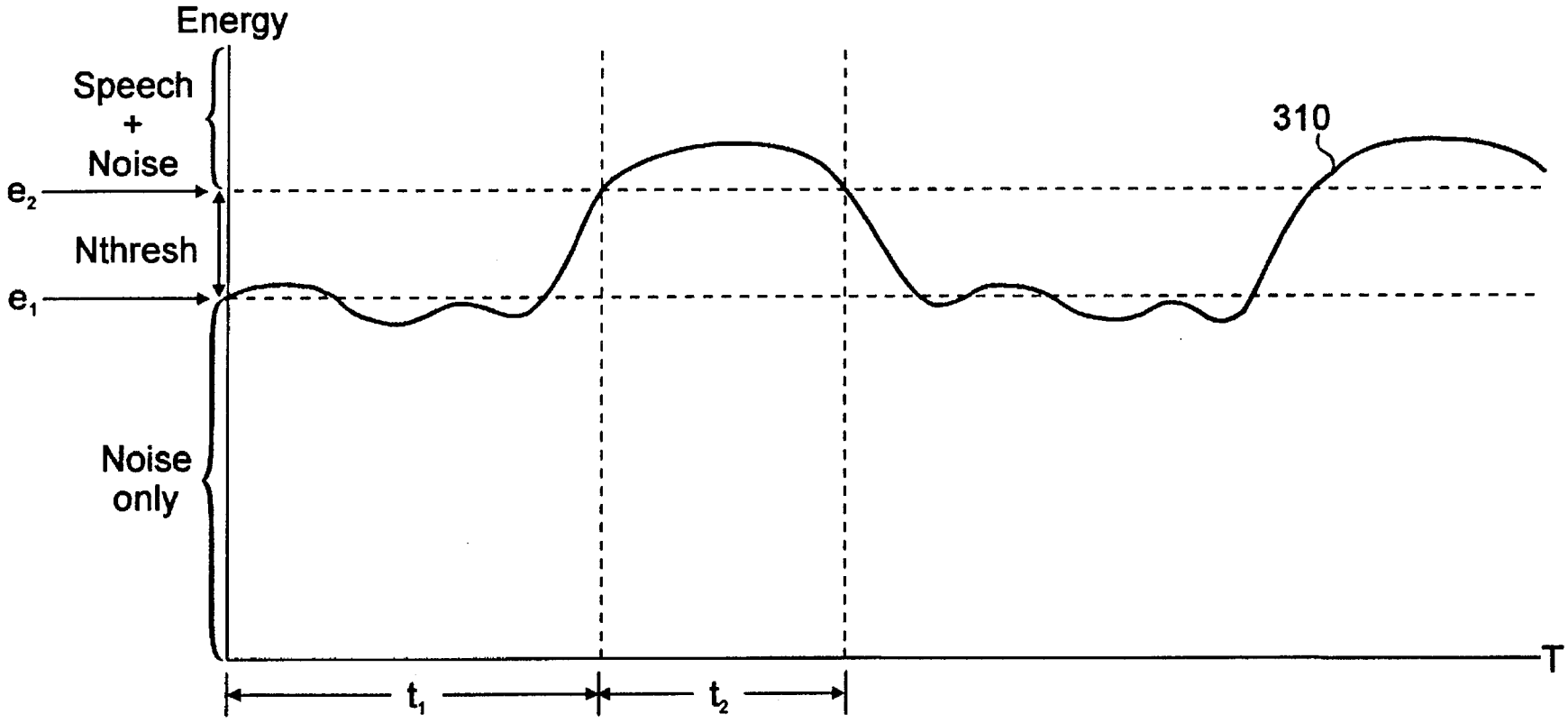
FIG. 3 is a waveform depicting the total acoustic energy of a received signal.

The average frame energy signal e[m] produced by the energy estimator 210 represents the average total acoustic energy present in the received speech signal. This total acoustic energy may be comprised of both speech and noise. As an example, FIG. 3 shows a waveform depicting the total acoustic energy of a typical received signal 310 over time T. In a mobile environment, there will typically be a certain level of ambient background noise. The energy level of this noise is shown in FIG. 3 as $e_1$. When speech is present in the signal 310, the acoustic energy level will represent both speech and noise. This is shown in FIG. 3 in the range where energy>$e_2$. During time interval $t_1$ speech is not present in the signal 310 and the acoustic energy during this time interval $t_1$ represents ambient background noise only. During time interval $t_2$, speech is present in the signal 310 and the acoustic energy during this time interval $t_2$ represents ambient background noise plus speech.

Referring to FIG. 2, the output signal e[m] produced by the energy estimator 210 is provided to a noise estimator 220 which determines the average background noise level in the decoded speech bit stream s. The noise estimator 220 generates a signal N[m] which represents a noise estimate value, where:

$$N[m] = \begin{cases} Ninit & \text{for } m = 0 \\ N[m-1] & \text{for } e[m] > N[m-1] + Nthresh \\ \beta * e[m] + (1-\beta) * N[m-1] & \text{otherwise} \end{cases}$$

Initially, N[m] is set to the initial value Ninit, which is an initial noise estimate. During further processing, the value N[m] will increase or decrease based upon the actual background noise present in the decoded speech bit stream s. Ninit is set to a level which is on the boundary between moderate and severe background noise. Initializing N[m] to this level permits N[m] to adapt quickly in either direction as determined by the actual background noise. We have found that in a mobile environment it is preferable to set Ninit to an r0 value of 13.

The speech component of signal energy should not be included in calculating the average background noise level. For example, referring to FIG. 3, the energy level present in the signal 310 during time interval $t_1$ should be included in calculating the noise estimate N[m], but the energy level present in the signal 310 during time interval $t_2$ should not be included because the energy during time interval $t_2$ represents both background noise and speech.

Thus, any average frame energy e[m], received from the energy estimator 210 which represents both speech and noise should be excluded from the calculation of the noise estimate N[m] in order to prevent the noise estimate N[m] from becoming biased. In order to exclude average frame energy e[m] values which represent both speech and noise, an upper noise clipping threshold, Nthresh, is used. Thus, as stated above, if e[m]>N[m−1]+Nthresh then N[m]=N[m−1]. In other words, if the current frame's average frame energy, e[m], is greater than the prior frame's noise estimate, N[M−1], by an amount equal to or greater than Nthresh, i.e. speech is present, then N[m] is not changed from the previous frame's calculation. Thus, if there is a large increase of frame energy over a short time period, then it is assumed that this increase is due to the presence of speech and the energy is not included in the noise estimate. We have found it optimal to set Nthresh to the equivalent of a frame energy r0 value of 2.5. This limits the operational range of the noise estimate algorithm to conditions with better than 5 db audio signal to noise ratio, since r0 is scaled in units of 2 db. Nthresh could be set anywhere in the range of 2 to 4 for acceptable performance of the noise estimator 220.

If there is not a large increase of frame energy over a short time period, then the noise estimate is determined by the equation $N[m]=\beta*e[m]+(1-\beta)*N[m-1]$, where $\beta$ is a smoothing constant which should be set to provide acceptable frame averaging. A value of 0.05 for $\beta$, which gives frame averaging over 25 frames (500 ms) has been found preferable. The value of $\beta$ should generally be set in the range of $0.025 \leqq \beta \leqq 0.1$.

The noise estimate value N[m] calculated by the noise estimator 220 is provided to a high pass filter driver 260 which operates on the decoded bit stream signal s provided from the speech decoder 40. As discussed above, each digital information frame contains 160 samples of speech data. The high pass filter driver 260 operates on each of these samples s[i], where i is a sampling index. The high pass filter driver 260 is shown in further detail in FIG. 4. The noise estimate value N[m] generated by the noise estimator 220 is provided to logic block 410 which contains logic circuitry to determine which of a set of high pass filters will be used to filter each sample s[i] of the decoded speech bit stream s. There are two high pass filters 430 and 440. Filter 430 has a cutoff frequency at 200 Hz and filter 440 has a cutoff frequency at 350 Hz. These cutoff frequencies have been determined to provide optimal results, however other values may be used in accordance with the present invention. The difference in cutoff frequencies between the filters should preferably be at least 100 Hz. In order to determine which filter should be used, the logic block 410 of the high pass filter driver 260 compares the noise estimate value N[m] with two thresholds. The first threshold is set to a value corresponding to a frame energy value r0=7 (corresponding to −52 db), and the second threshold is set to a value corresponding to a frame energy value r0=13 (corresponding to −40 db). If the noise estimate N[m] is less than r0=7, then there is no high pass filtering applied. If the noise estimate value N[m] is greater than or equal to r0=7 and less than r0=13, then the 200 Hz high pass filter 430 is applied. If the noise estimate value N[m] is greater than or equal to r0=13, then the 350 Hz high pass filter 440 is applied. The logic for determining the high pass filtering to be applied can be summarized as:

$$\text{filter} = \begin{cases} \text{all pass} & \text{for } N[m] < 7 \\ \text{high pass at 200 Hz} & \text{for } 7 \leqq N[m] < 13 \\ \text{high pass at 350 Hz} & \text{for } N[m] \geqq 13 \end{cases}$$

Figure 4:
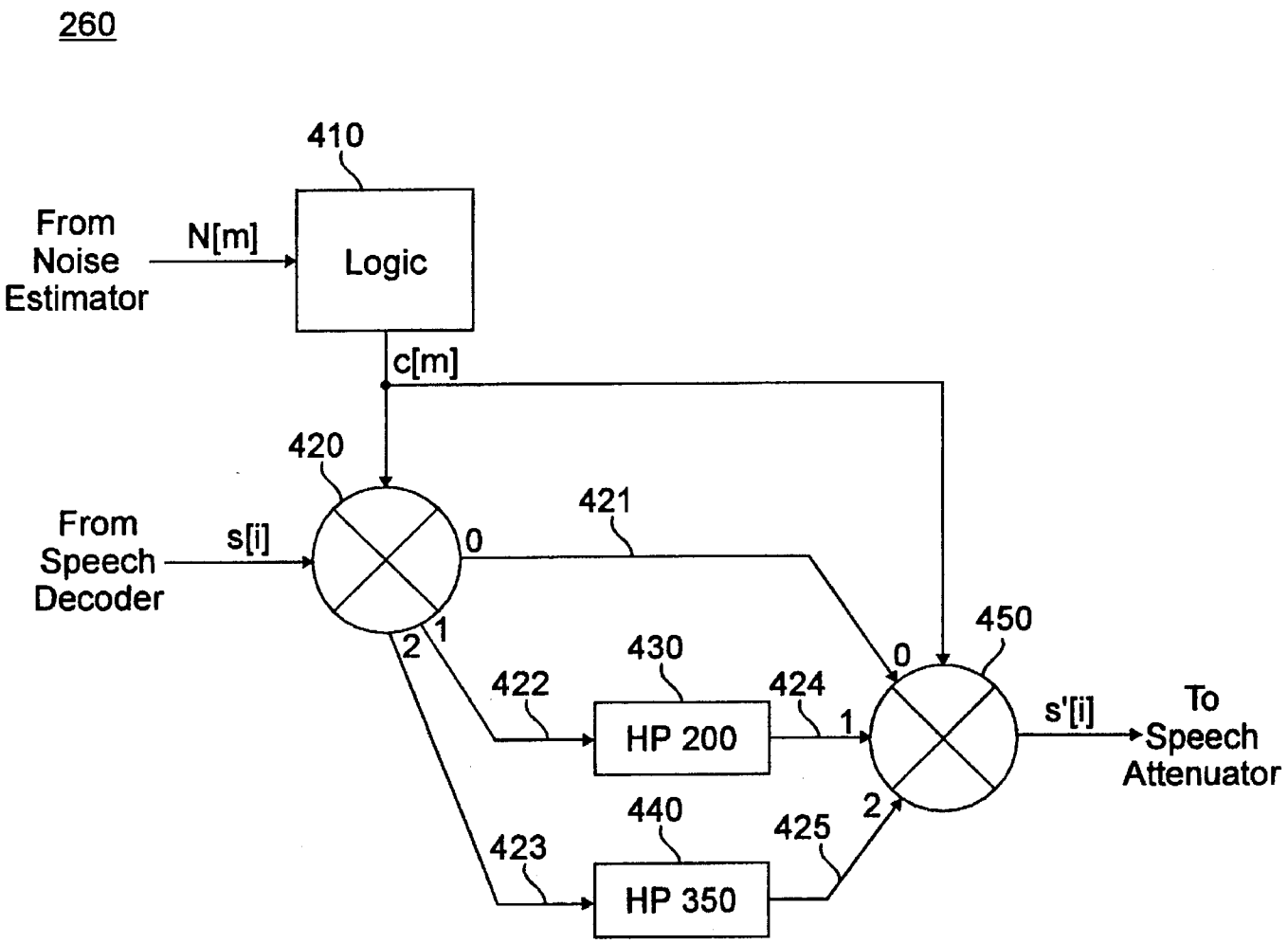
FIG. 4 is a block diagram of a high pass filter driver.

With reference to FIG. 4, this logic is carried out by logic block 410. Logic block 410 will determine which filter is to be applied based upon the above rules and will provide a control signal c[m] to two cross bar switches 420,450. A control signal corresponding to a value of 0 indicates that no high pass filtering should be applied. A control signal corresponding to a value of 1 indicates that the 200 Hz high pass filter should be applied. A control signal corresponding to a value of 2 indicates that the 350 Hz high pass filter should be applied.

The signal s[i] is provided to the cross bar switch 420 from the speech decoder 40. The cross bar switch 420 directs the signal s[i] to the appropriate signal line 421, 422, 423 to select the appropriate filtering. A control signal of 0 will direct signal s[i] to signal line 421. Signal line 421 will provide the signal s[i] to cross bar switch 450 with no filtering being applied. A control signal of 1 will direct signal s[i] to signal line 422, which is connected to high pass filter 430. After the signal s[i] is filtered by high pass filter 430, it is provided to cross bar switch 450 over signal line 424. A control signal of 2 will direct signal s[i] to signal line 423, which is connected to high pass filter 440. After the signal s[i] is filtered by high pass filter 440, it is provided to cross bar switch 450 over signal line 425. The control signal c[m] is also provided to the cross bar switch 450. Based upon the control signal c[m], cross bar switch 450 will provide one of the signals from signal line 421, 424, 425 to the speech attenuator 270. This signal produced by the high pass filter driver 260 is identified as s'[i]. Those skilled in the art will recognize that any number of high pass filters or a single high pass filter with a continuously adjustable cutoff frequency could be used in the high pass filter driver 260 to filter the decoded bit stream s. Use of a larger number of high pass filters or a single high pass filter with a continuously adjustable cutoff frequency would make the transitions between filter selections less noticeable.

Referring to FIG. 2, the signal s'[i] produced by the high pass filter driver 260 is provided to a speech attenuator/comfort noise inserter 270. The speech attenuator/comfort noise inserter 270 will process the signal s'[i] to produce the processed decoded speech bit stream output signal s"[i]. The speech attenuator/comfort noise inserter 270 also receives input signal n[i] from a shaped noise generator 250 and input signal atten[m] from an attenuator calculator 240. The functioning of the speech attenuator/comfort noise inserter 270 will be discussed in detail below, following a discussion of how its inputs n[i] and atten[m] are calculated.

Figure 5:
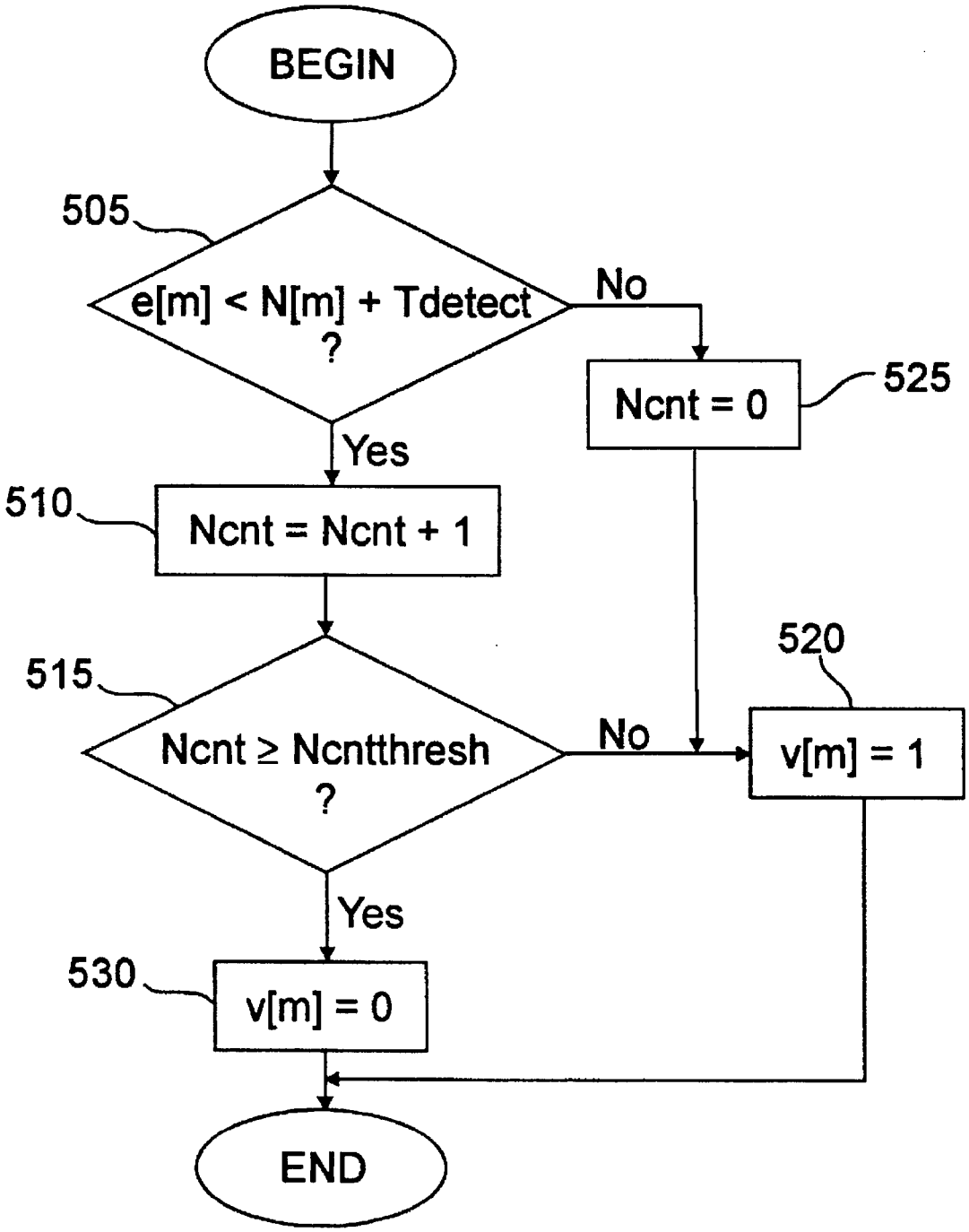
FIG. 5 is a flow diagram of the functioning of the voice activity detector.

The noise estimate N[m] produced by the noise estimator 220, and the average frame energy e[m] produced by the energy estimator 210, are provided to the voice activity detector 230. The voice activity detector 230 determines whether or not speech is present in the current frame of the speech signal and produces a voice detection signal v[m] which indicates whether or not speech is present. A value of 0 for v[m] indicates that there is no voice activity detected in the current frame of the speech signal. A value of 1 for v[m] indicates that voice activity is detected in the current frame of the speech signal. The functioning of the voice activity detector 230 is described in conjunction with the flow diagram of FIG. 5. In step 505, the voice activity detector 230 will determine whether e[m]<N[m]+Tdetect, where Tdetect is a lower noise detection threshold, and is similar in function to the Nthresh value discussed above in conjunction with FIG. 3. The assumption is made that speech may only be present when the average frame energy e[m] is greater than the noise estimate value N[m] by some value, Tdetect. Tdetect is preferably set to an r0 value of 2.5 which means that speech may only be present if the average frame energy e[m] is greater than the noise estimate value N[m] by 5 db. Other values may also be used. The value of Tdetect should generally be within the range 2.5±0.5.

In order to prevent the voice activity detector 230 from declaring no voice activity within words, an undetected frame counter Ncnt is used. Ncnt is initialized to zero and is set to count up to a threshold, Ncntthresh, which represents the number of frames containing no voice activity which must be present before the voice activity detector 230 declares that no voice activity is present. Ncntthresh may be set to a value of six. Thus, only if no speech is detected for six frames (120 ms) will the voice activity detector 230 declare no voice. Returning now to FIG. 5, if step 505 determines that e[m]<N[m]+Tdetect, i.e. the average energy e[m] is less than that for which it has been determined that speech may be present, then Ncnt is incremented by one in step 510. If step 515 determines that Ncnt≧Ncntthresh, i.e., that there have been 6 frames in which no speech has been detected, then v[m] is set to 0 in step 530 to indicate no speech for the current frame. If step 515 determines that Ncnt<Ncntthresh, i.e. that there have not yet been 6 frames in which no speech has been detected, then v[m] is set to 1 in step 520 to indicate there is speech present in the current frame. If step 505 determines that e[m]≧N[m] +Tdetect, i.e. the average energy e[m] is greater than or equal to that for which it has been determined that speech may be present, then Ncnt is set to zero in step 525 and v[m] is set to one in step 520 to indicate that there is speech present in the current frame.

The voice detection signal v[m] produced by the voice activity detector 230 is provided to the attenuator calculator 240, which produces an attenuation signal, atten[m], which represents the amount of attenuation of the current frame. The attenuation signal atten[m] is updated every frame, and its value depends in part upon whether or not voice activity was detected by the voice activity detector 230. The signal atten[m] will represent some value between 0 and 1. The closer to 1, the less the attenuation of the signal, and the closer to 0, the more the attenuation of the signal. The maximum attenuation to be applied is defined as maxatten, and it has been determined that the optimal value for maxatten is 0.65 (i.e., −3.7 db). Other values for maxatten may be used however, with the value generally being in the range 0.3 to 0.8. The factor by which the attenuation of the speech signal is increased is defined as attenrate, and the preferred value for attenrate has been found to be 0.98. Other values may be used for attenrate however, with the value generally in the range of 0.95±0.04.

In this section, we describe the calculation of the attenuation signal atten[m]. The use of atten[m] in attenuating the signal s'[i] will become clear during the discussion below in conjunction with the speech attenuator/comfort noise inserter 270. The attenuation signal atten[m] is calculated as follows. Initially, the attenuation signal atten[m] is set to 1. Following this initialization, atten[m] will be calculated based upon whether speech is present, as determined by the voice activity detector 230, and whether the attenuation has reached the maximum attenuation as defined by maxatten. If v[m]=1, i.e. speech is detected, then atten[m] is set to 1. If v[m]=0, i.e. no speech is detected, and if the attenuation factor applied to the previous frame's attenuation (attenrate*atten[m−1]) is greater than the maximum attenuation, then the current frame attenuation is calculated by applying the attenuation factor to the previous frame's attenuation. If v[m]=0, i.e. no speech is detected, and if the attenuation factor applied to the previous frame's attenuation is less than or equal to the maximum attenuation, then the current frame attenuation is set to the maximum attenuation. This calculation of the current frame attenuation is summarized as:

$$atten[m] = \begin{cases} 1.0 & \text{for } m = 0 \text{ or } v[m] = 1 \\ atten[m] = attenrate * atten[m-1] & \text{for } attenerate * atten[m-1] > maxatten \text{ and } v[m] = 0 \\ maxatten & \text{for } attenrate * atten[m-1] \leqq maxattn \text{ and } v[m] = 0 \end{cases}$$

Thus, when no speech is detected by the voice activity detector 230, the attenuation signal atten[m] is reduced from 1 to 0.65(maxatten) by a constant factor 0.98. The current frame attenuation signal, atten[m], generated by the attenuation calculator 240 is provided to the speech attenuator/comfort noise inserter 270.

The speech attenuator/comfort noise inserter 270 also receives the signal n[i], which represents low-pass filtered white noise, from the shaped noise generator 250. This low pass filtered white noise is also referred to as comfort noise. The shaped noise generator 250 receives the noise estimate N[m] from the noise estimator 220 and generates the signal n[i] which represents the shaped noise as follows:

$$n[i] = \epsilon * wn[i] + (1 - \epsilon) * n[i-1] \text{ where,}$$

$$wn[i] = \delta * dB2lin\ (N[m]) * ran[i]$$

where i is the sampling index as discussed above. Thus, n[i] is generated for each sample in the current frame. The function dB21in maps the noise estimate N[m] from a dB to a linear value. The scale factor $\delta$ is set to a value of 1.7 and the filter coefficient $\epsilon$ is set to a value of 0.1. The function ran[i] generates a random number between −1.0 and 1.0. Thus, the noise is scaled using the noise estimate N[m] and then filtered by a low pass filter. The above stated values for the scale factor $\delta$ and the filter coefficient $\epsilon$ have been found to be optimal. Other values may be used however, with the value of $\delta$ generally in the range 1.5 to 2.0, and the value $\epsilon$ generally in the range 0.05 to 0.15.

The low-pass filtered white noise n[i] generated by the shaped noise generator 220 and the current frame's attenuation atten[m] generated by the attenuator calculator 240 are provided to the speech attenuator/comfort noise inserter 270. The speech attenuator receives the high pass filtered signal s'[i] from the high pass filter driver 260 and generates the processed decoded speech bit stream s" according to the following equation:

$$s''[i]=atten[m]*s'[i]+(1-atten[m])\ ,\ n[i],\ \text{for } i=0,1,\ldots,159$$

Thus, for each sample s'[i] in the high pass filtered speech signal s', the speech attenuator/comfort noise inserter 270 will attenuate the sample s'[i] by the current frame's attenuation atten[m]. At the same time, the speech attenuator/comfort noise inserter 270 will also insert the low pass filtered white noise n[i] based on the value of atten[m]. As can be seen from the above equation, if atten[m]=1, then there will be no attenuation and s"[i]=s'[i]. If atten[m]=maxatten (0.65) then s"[i]=(0.65*high pass filtered speech signal)+(0.35*low pass filtered white noise). The effect of the attenuation of the signal s'[i] plus the insertion of low pass filtered white noise (comfort noise) is to provide a smoother background noise with less perceived swirl. The signal s"[i] generated by the speech attenuator/comfort noise inserter 270 may be provided to the digital to analog converter 60, or to another device that converts the signal to some other digital data format, as discussed above.

As discussed above, the attenuator calculator 240, the shaped noise generator 250, and the speech attenuator/comfort noise inserter 270 operate in conjunction to reduce the background swirl when no speech is present in the received signal. These elements could be considered as a single noise remediator, which is shown in FIG. 2 within the dotted lines as 280. This noise remediator 280 receives the voice detection signal v[m] from the voice activity detector 230, the noise estimate N[m] from the noise estimator 220, and the high pass filtered signal s'[i] from the high pass filter driver 260, and generates the processed decoded speech bit stream s"[i] as discussed above.

Figure 6:
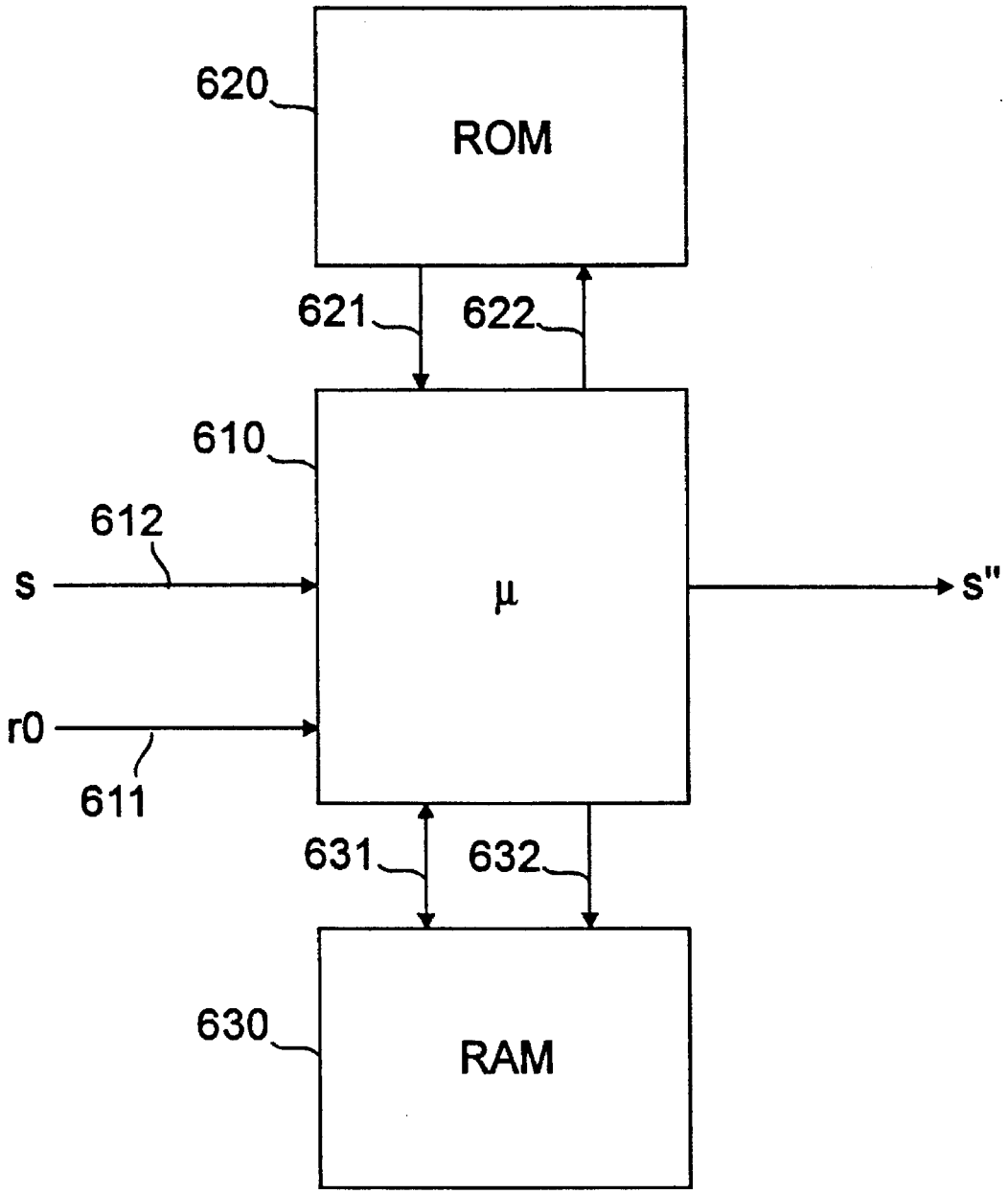
FIG. 6 shows a block diagram of a microprocessor embodiment of the present invention.

A suitable VADDNR 50 as described above could be implemented in a microprocessor as shown in FIG. 6. The microprocessor (μ) 610 is connected to a non-volatile memory 620, such as a ROM, by a data line 621 and an address line 622. The non-volatile memory 620 contains program code to implement the functions of the VADDNR 50 as discussed above. The microprocessor 610 is also connected to a volatile memory 630, such as a RAM, by data line 631 and address line 632. The microprocessor 610 receives the decoded speech bit stream s from the speech decoder 40 on signal line 612, and generates a processed decoded speech bit stream s". As discussed above, in one embodiment of the present invention, the VSELP coded frame energy value r0 is provided to the VADDNR 50 from the encoded speech bit stream b. This is shown in FIG. 6 by the signal line 611. In an alternate embodiment, the VADDNR calculates the frame energy value r0 from the decoded speech bit stream s, and signal line 611 would not be present.

It is to be understood that the embodiments and variations shown and described herein are illustrative of the principles of the invention only and that various modifications may be implemented by those skilled in the art without departing from the scope and spirit of the invention. Throughout this description, various preferred values, and ranges of values, have been disclosed. However, it is to be understood that these values are related to the use of the present invention in a mobile environment. Those skilled in the art will recognize that the invention disclosed herein may be utilized in various environments, in which case values, and ranges of values, may vary from those discussed herein. Such use of the present invention in various environments along with the variations of values are within the contemplated scope of the present invention.

We claim:

1. A receiving apparatus for processing a received encoded signal, said received encoded signal comprising a speech component and a noise component, said apparatus comprising:

a speech decoder for receiving said encoded signal and generating a decoded signal, said decoded signal comprising a speech component and a noise component;

an energy estimator connected to said speech decoder for receiving said decoded signal and for generating an estimated energy signal representing the acoustic energy of said decoded signal;

a noise estimator connected to said energy estimator for receiving said estimated energy signal and for generating an estimated noise signal representing the average background noise level in said decoded signal;

a high pass filter driver connected to said noise estimator and said speech decoder for receiving said estimated noise signal and said decoded signal, and for high pass filtering said decoded signal based upon said estimated noise signal, and for generating a high pass filtered output signal;

a voice activity detector connected to said energy estimator and said noise estimator for receiving said estimated energy signal and said estimated noise signal and for generating a voice detection signal representing whether said decoded signal contains a speech component;

an attenuator calculator connected to said voice activity detector for receiving said voice detection signal and for generating an attenuation signal representing the attenuation to be applied to said high pass filtered signal;

a noise generator connected to said noise estimator for receiving said estimated noise signal and for generating a comfort noise signal; and a speech attenuator/comfort noise inserter connected to said high pass filter driver, said shaped noise generator, and said attenuator calculator, for receiving said high pass filtered output signal, said comfort noise signal, and said attenuation signal, and for attenuating said high pass filtered output signal and inserting said comfort noise signal into said high pass filtered output signal based upon said attenuation signal, and for generating a processed high pass filtered signal wherein said speech decoder, noise estimator and said voice activity detector are in said receiving apparatus.

2. The apparatus of claim 1 wherein said comfort noise signal comprises low pass filtered white noise.

3. A receiving apparatus for processing a received signal, said signal comprising a speech component and a noise component, said apparatus comprising:

an energy estimator for generating an energy signal representing the acoustic energy of said received signal;

a noise estimator for receiving said energy signal and for generating a noise estimate signal representing the average background noise in said received signal;

a voice activity detector for receiving said noise estimate signal and said energy signal and for generating a voice detection signal representing whether speech is present in said received signal; and a noise remediator responsive to said noise estimate signal and said voice detection signal for processing said received signal when said voice detection signal indicates that speech is not present in said received signal and for generating a processed signal, wherein said noise estimator, said voice activity detector and said noise remediator are in said receiving apparatus, wherein said processed signal comprises:

a first component comprising an attenuated received signal; and a second component comprising a comfort noise signal.

4. The apparatus of claim 3 wherein said voice acting detector generates a voice detection signal indicating that speech is not present only when no speech is detected in said received signal for a predetermined period of time.

5. The apparatus of claim 3 wherein said comfort noise comprises low pass filtered white noise.

6. The apparatus of claim 3 wherein said noise remediator further comprises:

an attenuator calculator for receiving said voice detection signal and for generating an attenuation signal representing the attenuation to be applied to said received signal;

a shaped noise generator for receiving said noise estimate signal and for generating said comfort noise signal; and a speech attenuator/comfort noise inserter responsive to said comfort noise signal and said attenuation signal for receiving said received signal and for attenuating said received signal and inserting said comfort noise signal into said received signal.

7. The apparatus of claim 6 wherein said comfort noise signal represents low pass filtered white noise scaled based upon said noise estimate signal.

8. A receiving apparatus for processing a received signal having speech and noise components, said apparatus comprising:

an energy estimator in said receiving apparatus for generating an energy signal representing the acoustic energy of said received signal;

a noise estimator in said receiving apparatus for receiving said energy signal and for generating a noise estimate signal representing the average background noise in said received signal;

a plurality of high pass filters; and means for applying one of said plurality of high pass filters to said received signal based upon said noise estimate signal and for generating a high pass filtered signal.

9. The apparatus of claim 8 wherein the difference in the cutoff frequencies of each of said plurality of high pass filters is at least 100 Hz.

10. A receiving apparatus for processing a received signal having speech and noise components, said apparatus comprising:

and energy estimator for generating an energy signal representing the acoustic energy of said received signal;

a noise estimator for receiving said energy signal and for generating a noise estimate signal representing the average background noise in said received signal;

a high pass filter driver connected to said noise estimator for filtering said received signal based upon said noise estimate signal and generating a high pass filtered signal;

a voice activity detector for receiving said noise estimate signal and said energy signal and for generating a voice detection signal representing whether speech is present in said received signal; and a noise remediator responsive to said noise estimate signal and said voice detection signal for attenuating said high pass filtered signal and inserting comfort noise into said high pass filtered signal when said voice detection signal indicates that speech is not present in said received signal.

11. The apparatus of claim 10 wherein said high pass filter driver further comprises:

a first high pass filter;

a second high pass filter; and means for applying said first high pass filter, said second high pass filter, or no high pass filter, to said received signal based upon said noise estimate signal.

12. The apparatus of claim 11 wherein the difference in the cutoff frequencies of said first high pass filter and said second high pass filter is at least 100 Hz.

13. The apparatus of claim 10 wherein said voice activity detector generates a voice detection signal indicating that speech is not present only when no speech is detected in said received signal for a predetermined period of time.

14. The apparatus of claim 10 wherein said noise remediator further comprises:

an attenuator calculator for receiving said voice detection signal and for generating an attenuation signal representing the attenuation to be applied to said high pass filtered signal;

a shaped noise generator for receiving said noise estimate signal and for generating a comfort noise signal representing low pass filtered white noise; and a speech attenuator/comfort noise inserter responsive to said comfort noise signal and said attenuation signal for receiving said high pass filtered signal and for attenuating said high pass filtered signal and for inserting said comfort noise signal into said high pass filtered signal.

15. A method for processing an encoded signal, said encoded signal representing speech and noise, said method comprising the steps:

receiving said encoded signal at a receiver in a communication system;

decoding said encoded signal into a decoded signal;

generating an energy signal representing the acoustic energy of said decoded signal;

generating a noise estimate signal representing the average background noise level in said decoded signal;

generating a voice detection signal based upon said energy signal and said noise estimate signal, said voice detection signal indicating whether said decoded signal contains a speech component; and if said voice detection signal indicates that said decoded signal does not contain a speech component:

generating a comfort noise signal based upon said noise estimate signal;

attenuating said decoded signal; and inserting said comfort noise signal into said decoded signal.

16. The method of claim 15 wherein said step of generating an energy value representing the acoustic energy of said decoded signal further comprises the step of receiving an encoded energy value from said encoded signal.

17. The method of claim 15 wherein said step of generating an comfort noise signal further comprises the steps of:

generating a white noise signal;

scaling said white noise signal based upon said noise estimate signal; and low pass filtering said scaled white noise signal.

18. The method of claim 15 wherein said step of generating a voice detection signal further comprises the step of:

generating a voice detection signal indicating that no speech is present only if no speech has been detected in the decoded signal for a predetermined time period.

19. A method for processing a received encoded signal representing speech and noise, said method comprising the steps:

receiving said encoded signal at a receiver in a communication system;

decoding said encoded signal into a decoded signal;

generating an energy value representing the acoustic energy of said decoded signal;

generating a noise estimate value representing the average background noise level in said decoded signal;

determining whether said decoded signal contains a speech component based upon said energy value and said noise estimate value; and if said decoded signal does not contain a speech component for a predetermined period of time:

attenuating said decoded signal; and inserting comfort noise into said decoded signal.

20. The method of claim 19 wherein said comfort noise comprises low pass filtered white noise scaled based upon said noise estimate value.

21. A method for processing a received signal representing speech and noise, said method comprising the steps of:

generating an energy signal representing the acoustic energy of said received signal, said received signal does not contain any specialized non-speech frames;

generating a noise estimate signal representing the average background noise in said received signal; and generating a high pass filtered signal by applying said received signal to one of a plurality of high pass filters based upon said noise estimate signal.

22. The method of claim 21 wherein the difference in the cutoff frequencies of each of said plurality of high pass filters is at least 100 Hz.

23. The method of claim 21 further comprising the steps of: generating a voice detection signal based upon said energy signal and said noise estimate signal, said voice detection signal indicating whether said received signal contains a speech component; and generating a processed high pass filtered signal if said voice detection signal indicates that said received signal does not contain a speech component.

24. The method of claim 23 wherein said step of generating a processed high pass filtered signal further comprises the steps of:

generating a comfort noise signal based upon said noise estimate signal;

attenuating said high pass filtered signal; and inserting said comfort noise signal into said high pass filtered signal.

25. The method of claim 24 wherein said comfort noise signal comprises low pass filtered white noise scaled based upon said noise estimate signal.

26. A method for processing a received signal representing speech and noise, said method comprising the steps of:

generating an energy value representing the acoustic energy of said received signal, wherein said received signal does not contain special non-speech frames;

generating a noise estimate value representing the average background noise in said received signal;

generating a high pass filtered signal by applying said received signal to one of a plurality of high pass filters based upon said noise estimate value;

generating comfort noise based on said noise estimate value;

determining whether said received signal contains a speech component based upon said energy value and said noise estimate value; and generating a processed high pass filtered signal if said received signal does not contain a speech component.

27. The method of claim 26 wherein the difference in the cutoff frequencies of each of said plurality of high pass filters is at least 100 Hz.

28. The method of claim 26 wherein said step of generating a processed high pass filtered signal further comprises the steps of:

attenuating said high pass filtered signal; and inserting said comfort noise into said high pass filtered signal.

29. A receiving apparatus for processing a received encoded signal representing speech and noise, said apparatus comprising:

means for receiving said encoded signal, wherein said encoded signal does not contain special non-speech frames;

means for decoding said encoded signal into a decoded signal;

means for generating an energy value representing the acoustic energy of said decoded signal;

means for generating a noise estimate value representing the average background noise level in said decoded signal;

means for determining whether said decoded signal contains a speech component based upon said energy value and said noise estimate value; and means for generating a processed decoded signal if the decoded signal does not contain a speech component for a predetermined period of time, said processed decoded signal comprising an attenuated decoded signal component and a comfort noise component.

30. The apparatus of claim 29 wherein said means for generating an energy value representing the acoustic energy of said decoded signal further comprises means for receiving an encoded energy value from said encoded signal.

31. A receiving apparatus for processing a received signal, said received signal comprising a speech component and a noise component, said apparatus comprising:

means for generating an energy value representing the acoustic energy of said received signal;

means for generating a noise estimate value representing the average background noise in said received signal; and means for generating a high pass filtered signal by applying said received signal to one of a plurality of high pass filters based upon said noise estimate value, wherein said energy value generating means and said high pass filter generating means are in said receiving apparatus.

32. The apparatus of claim 31 wherein the difference in the cutoff frequencies of each of said plurality of high pass is at least 100 Hz.

33. The apparatus of claim 31 further comprising:

means for determining whether said received signal contains a speech component; and means for generating a processed high pass filtered signal if said received signal does not contain a speech component.

34. The apparatus of claim 33 wherein said means for generating a processed high pass filtered signal further comprises:

means for generating comfort noise based on said noise estimate value;

means for attenuating said high pass filtered signal; and means for inserting said comfort noise into said high pass filtered signal.

35. A receiving apparatus for processing a received encoded signal representing speech and noise, said apparatus comprising:

a speech decoder for receiving said encoded signal and generating a decoded signal, wherein said encoded signal does not contain special non-speech frames;

an energy estimator for receiving an encoded energy value from said encoded signal and for generating an energy signal representing the acoustic energy of said encoded signal;

a noise estimator connected to said energy estimator for receiving said energy signal and for generating a noise estimate signal representing the average background noise level in said encoded signal;

a high pass filter driver connected to said noise estimator and said speech decoder for receiving said noise estimate signal and said decoded signal and for high pass filtering said decoded signal based upon said noise estimate signal, and for generating a high pass filtered signal;

a voice activity detector connected to said energy estimator and to said noise estimator for receiving said energy signal and said noise estimate signal and for generating a voice detection signal representative of whether said encoded signal contains a speech component; and a noise remediator connected to said voice activity detector, said noise estimator, and said high pass filter driver for receiving said voice detection signal, said noise estimate signal, and said high pass filtered signal, and for generating a processed high pass filtered signal when said noise detection signal indicates that said encoded signal does not contain a speech component, wherein said processed high pass filtered signal comprises:

an attenuated high pass filtered signal; and low pass filtered white noise.

* * * * *